US007806038B2

(12) United States Patent
Duke

(10) Patent No.: US 7,806,038 B2
(45) Date of Patent: Oct. 5, 2010

(54) MODULAR POLYMERIC PROJECTILE ABSORBING ARMOR

(76) Inventor: Leslie P. Duke, 8 Ridgedale Dr., S.E., Silver Creek, GA (US) 30173

( * ) Notice: Subject to any disclaimer, the term of this patent is extended or adjusted under 35 U.S.C. 154(b) by 325 days.

(21) Appl. No.: 11/180,843

(22) Filed: Jul. 13, 2005

(65) Prior Publication Data

US 2007/0006542 A1 Jan. 11, 2007

Related U.S. Application Data

(60) Provisional application No. 60/587,940, filed on Jul. 14, 2004, provisional application No. 60/590,215, filed on Jul. 22, 2004.

(51) Int. Cl.
*F41H 5/24* (2006.01)

(52) U.S. Cl. ..... 89/36.04; 89/36.01

(58) Field of Classification Search ..... 89/36.01, 89/36.02, 36.04; 428/911
See application file for complete search history.

(56) References Cited

U.S. PATENT DOCUMENTS 964,160 A * 7/1910 Hammett ..... 52/590.1
3,305,982 A * 2/1967 Steele ..... 52/90.1
3,667,186 A * 6/1972 Kato ..... 52/592.2
4,189,252 A * 2/1980 Inman ..... 405/33
4,388,874 A * 6/1983 Stone ..... 109/79
4,683,800 A * 8/1987 Snedeker ..... 89/36.02
4,760,611 A * 8/1988 Huet et al. ..... 2/2.5
4,763,457 A * 8/1988 Caspe ..... 52/504
4,896,472 A * 1/1990 Hunt ..... 52/592.6
5,337,527 A * 8/1994 Wagenaar ..... 52/169.2
5,365,714 A * 11/1994 Potvin ..... 52/590.2
5,393,811 A * 2/1995 Moran et al. ..... 524/71
6,079,902 A * 6/2000 Pettee, Jr. ..... 405/35
6,250,986 B1 * 6/2001 Sorensen ..... 446/85
6,616,499 B1 * 9/2003 Sorensen ..... 446/85
6,695,534 B2 * 2/2004 Cain et al. ..... 405/52
7,192,643 B2 * 3/2007 Perez et al. ..... 428/400

* cited by examiner

*Primary Examiner*—Michelle Clement
(74) *Attorney, Agent, or Firm*—Womble Carlyle Sandridge & Rice PLLC

(57) ABSTRACT

A building block that can be assembled into structures without requiring special end or corner pieces. The block has top and bottom surfaces that contain a cooperating projection and slot for stacking the blocks. Two end surfaces and two side surfaces complete an enclosed volume. One side and one end surface has at least one interlocking male portion. The other side end surface has at least one cooperating slot portion into which the male portion fits to interlock the blocks.

5 Claims, 8 Drawing Sheets

MODULAR POLYMERIC PROJECTILE ABSORBING ARMOR

CROSS REFERENCE TO RELATED APPLICATION

The present patent application is a formalization of previously filed, U.S. provisional patent application Ser. Nos. 60/587,940, filed Jul. 14, 2004, and 60/590,215, filed Jul. 22, 2004, both by the inventor named in the present application. This patent application claims the benefit of the filing date of the cited provisional patent applications according to the statutes and rules governing provisional patent applications, particularly USC §119(e)(1) and 37 CFR §1.78(a)(4) and (a)(5). The specification and drawings of the provisional patent application are specifically incorporated herein by reference.

FIELD OF THE INVENTION

The present invention generally relates to modular building blocks, and in particular, to an improved modular armor that will absorb and capture incoming projectiles such as bullets, slugs, sabot slugs, shrapnel, and the like. The munitions protected against may include standard "ball" rounds, armor piercing (AP), full metal jacket (FMJ), armor piercing incendiary (API), high explosive (HE), and incendiary rounds. The structure of the block also allows flexible interconnection to build a variety of structures in situations where armor protection is not required.

BACKGROUND OF THE INVENTION

The hostile environment of the world today has led to the need for portable armor that can be used to quickly construct shelters or fortifications in the field. This armor needs to be both lightweight and capable of stopping projectiles. In addition, such armor should be relatively inexpensive, easily transportable, and easy to assemble into structures. The term "structures" can encompass walls, enclosed bunkers, or in some cases, can even be used on vehicles to provide additional armor. Such an armor structure should be usable to either augment protection provided by exterior walls of existing structures, or be assembled into stand alone structures. In particular, it would be useful for such an armor to be easily field transportable and simple to use in the field.

SUMMARY OF THE INVENTION

The inventor of the present invention discovered in his work with ballistic absorbing polymeric materials that a polymeric block could be constructed that would have excellent ballistic absorbing properties. It has been found that by modifying this structure, a relatively lightweight polymeric projectile absorbing armor can be made and that it can be formed into readily assembled building block shapes. The material is preferably a polymeric foam material and can include one or more layers of such material. In the preferred embodiment, there are at least two layers of material for purposes that will be explained. In addition, the shape of the blocks themselves allows easy interconnection to build other structures. The blocks can be made from a non-ballistic absorbing material and formed into structures where armor protection is not required. For example, retaining walls or children's playhouses could be built from these blocks.

DETAILED DESCRIPTION OF THE INVENTION

Figure 1:
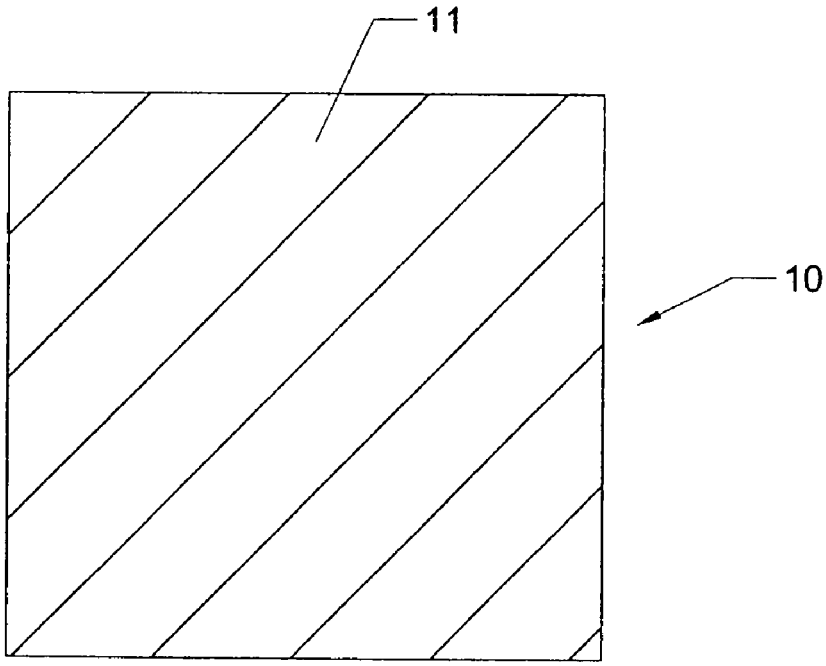
FIG. 1 is a cross section of one embodiment of the interior structure of the present invention.

FIG. 1 shows the polymeric armor block 10 of the present invention in a cross sectional simplified form. In one embodiment of the invention, the block 10 is made from at least one layer of a foamed high molecular weight, high density polyethylene 11. High density, high molecular weight polyethylene is defined as high density polyethylene with molecular weights at or above the $10^6$-$10^7$ Dalton range. It has been found that this material will become fluid and flow to some degree when struck by a high velocity projectile. A high velocity projectile encountering the surface plane of a polymeric armor block 10 made from high molecular weight polyethylene 11 at a perpendicular angle or relatively low angle of incidence, will penetrate the outer surface of the block 10 and decelerate rapidly to a complete stop, often within a matter of inches. The armor thus absorbs and captures incoming projectiles. The block 10 can be customized to various thicknesses to protect against anticipated high velocity projectiles. Twelve inches of this material has been shown to stop the following munitions:

.50 caliber-BMG ball, AP, APIT, incendiary, and Roufuss

.30-06 caliber-ball and tracer 7.62×39 mm (AK-47 standard)-ball, AP, tracer

.223 caliber-ball, AP 5.45×39 mm (AK-74 standard)-ball

Figure 2:
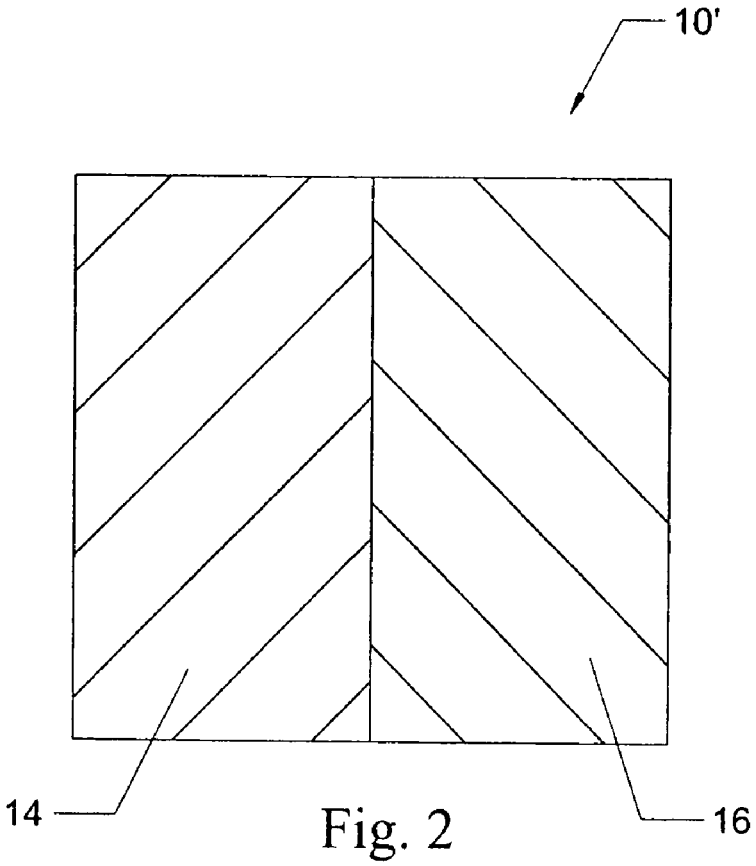
FIG. 2 is a cross section of a different embodiment of the structure of the present invention.

As the angle of incidence to the surface plane of the block 10 increases, the ability of the polymeric material 11 to capture and absorb projectiles varies in accordance with the velocity of the projectile and the density of the polymer 11. Relatively low velocity projectiles encountering the surface plane off the armor of the block 10 at a relatively high level of incidence tend to bounce or ricochet off the material if the surface density is too high, for example, around 0.95 to 1.5 g/cc or higher. Thus, it is advantageous in some cases to fabricate the block 10 in multiple layers with a layer of somewhat lower density material, for example, around 0.2-0.95 g/cc at the surface of the block, and a second layer of higher density material, around 0.95-1.5 g/cc or higher below the first layer. The lower density material may be same polymeric material as the higher density material, but more highly foamed. Alternatively, two different polymeric formations may be joined together, with a lower density polymer disposed toward the direction of incoming projectiles. FIG. 2 illustrates a modified block 10' that is made of two layers as just described, a first layer 14 and a second layer 16. The first layer 14 is assumed to be facing the direction from which projectiles would be coming, and is thus of the lower density polymeric material. The second layer 16 then is of the higher density polymeric material as just descried.

Once the basic internal structure of the block 10 has been determined, based on the anticipated projectiles to be protected against, the block 10 can be fabricated into a number of shapes so that the shapes may function as convenient building blocks for assembling a plurality of individual, modular units into armor for a larger structure, or to provide an armor structure, itself. A structure built of the blocks 10 will provide significant blast or shock wave protection, as well as protection against projectiles. Fabricating the blocks 10 into modular building blocks has the advantage of concentrating the armor material in a relatively small volume for transportation to a field site where the blocks 10 will be assembled and used. The configuration of the blocks 10 allow them to be assembled into a wide variety of shapes, either to augment the protection offered by the exterior walls of existing structures or vehicles, or alternatively, to assemble the blocks 10 into stand alone structures such as walls or enclosed bunkers.

While the discussion herein will be primarily directed toward the armor protective version of the block 10, the shape of the block 10 lends itself to construction of multiple structures that do not have to be armor protective. Thus, the same block 10 may be manufactured from low density polymer, concrete, composite, or even blow molded from polymer for light duty applications. The structure and interlocking ability of the blocks 10 provides a flexible building product.

Figure 3:
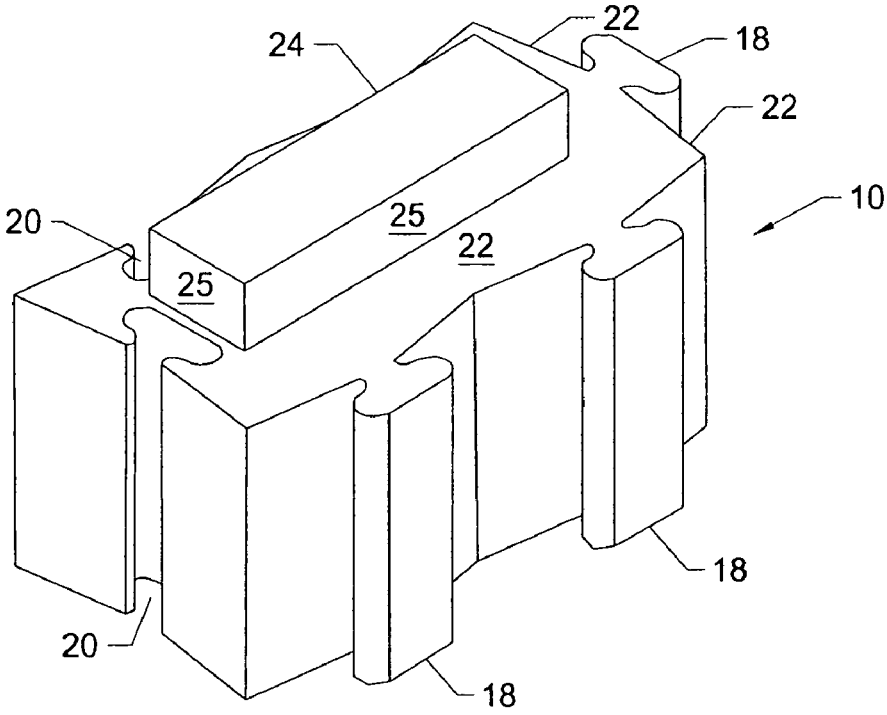
FIG. 3 is a view of a building block made in accordance with the present invention.
Figure 4:
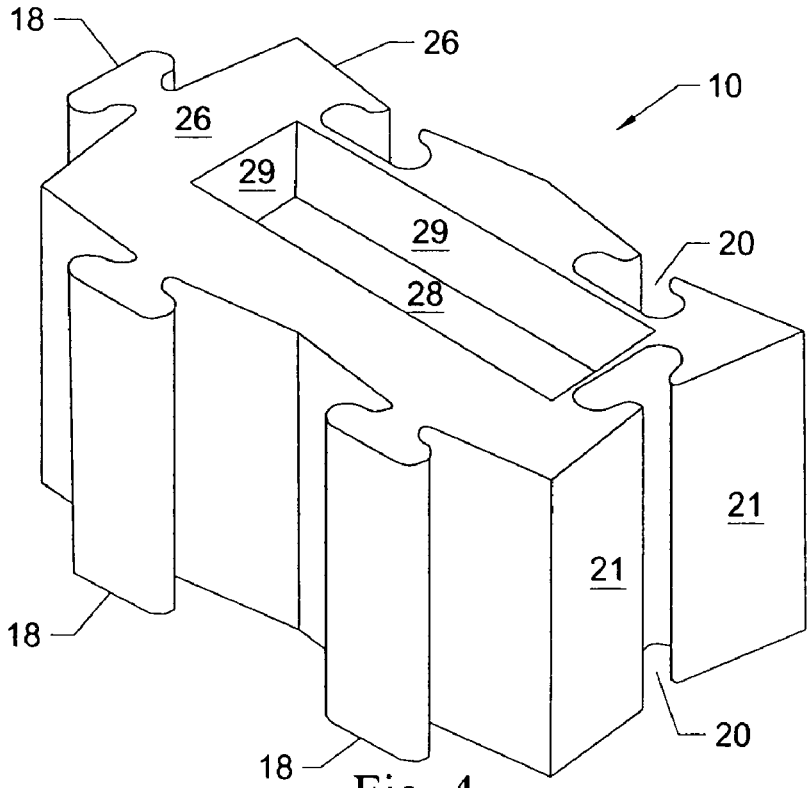
FIG. 4 is a view of the block of FIG. 3 from the bottom.

FIG. 3 illustrates a preferred configuration for the armor block 10. The external shape of the armor block 10 is designed to allow a wide range of larger shapes or structures to be constructed from a single plurality of block units, all of which block units are the same size and shape. The commonly used children's Lego® blocks are one example of block like structures which are familiar and may be used in this manner. However, Lego® blocks cannot be locked together like the blocks 10 of the present invention which does not require separate corner or end pieces. One advantage of using a plurality of block units, all of a single, uniform shape, is that it minimizes the amount of planning and administration associated with maintaining inventory and assembling quantities of material and construction kits for transportation to and construction at remote locations. In other words, each and every block 10 in a structure is interchangeable with every other block 10 in a structure. Any given block 10 can be interlocked, and interconnected into an interlocking structure, regardless of whether the block 10 is situated on the top or bottom of the structure or is located at the corner or along the wall of the structure. That is one can consider the block 10 to be capable of interlocking on all six sides. In FIG. 3, the block 10 is seen from a top front angle. The block includes interlocking male portions 18. The interlocking male portions 18 are sized to be received in corresponding slot portions 20. The block 10 includes a top surface 22, which has extending from it a generally rectangular projection 24 that is used to fit into a corresponding rectangular slot (see FIG. 4) to allow stacking of the blocks 10. In FIG. 4, the block 10 is seen from the bottom. The block 10 includes a lower surface 26 into which is formed a slot 28 that cooperates with the rectangular projection 24 to allow stacking of the blocks 10. The rectangular projection 24 and the slot or recess 28 are sized to cooperate with one another. In this view of the block 10, the interlocking portions 18 and corresponding slots 20 are seen from the bottom side of the block 10.

The blocks 10 can be fabricated in a height, width, and depth so that the weight of the block 10 can be readily lifted and transported short distances by hand for manual assembly of the blocks into a larger structure. This is a function of the polymeric material used in the blocks and the size of the blocks themselves. It has been found that a block 10 can be constructed using the structure of either FIG. 1 or FIG. 2, depending upon the purpose for which they are needed, with an overall height, width, and length dimension of 8 inches by 8 inches by 16 inches, and a weight of approximately 40 lbs. This weight is readily transportable by individuals and is also of a weight that will allow ease in assembly and stacking of the blocks 10.

With reference to FIGS. 3 and 4, it can be seen that the male portions 18, the slots 20, the top projection 24, the bottom slot 28, and the walls connecting them are all tapered. It has been found that heavy caliber projectiles, such as 50 caliber, have penetration power that requires subtle revision to the blocks 10. While stacking to avoid long, linear seams is useful, other measures are also needed. Tapering the end walls 21 in and toward the slot 20 and the end wall 22, outward away from the male portion 18 creates a non-linear joint that will cause tumbling and consequently capture of projectiles. The vertical side walls 25 of the projection 24 can also be tapered to match a taper of the side walls 29 of the bottom slot 28. The preferred angle is about 14° to 16° for armor blocks. The angle can go as high as 20°, but over 20° binding in assembling the blocks seems to occur and the block is made weaker. However, when projectile protection is not needed, the angle of taper can be zero. This would be the case when the blocks 10 are used for flood wall construction, for example.

Figure 5:
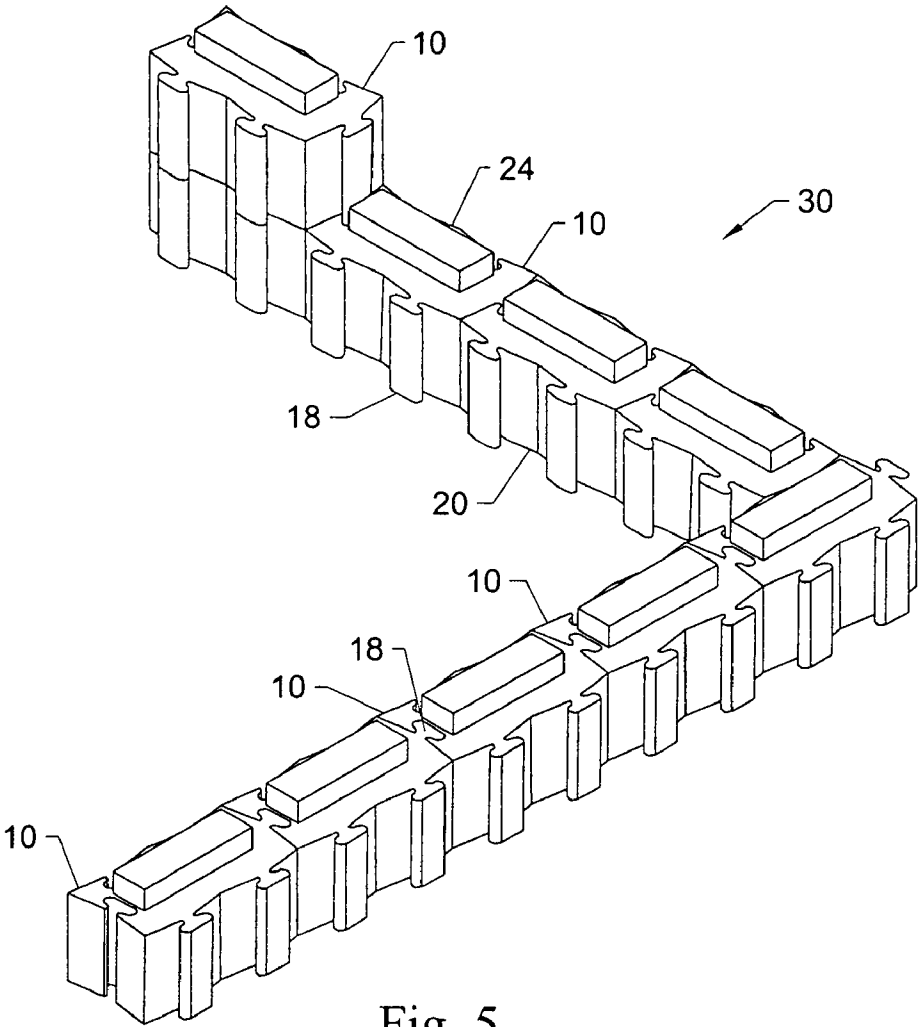
FIG. 5 illustrates the assembly of a plurality of the armored building blocks of the present invention into rows.
Figure 6:
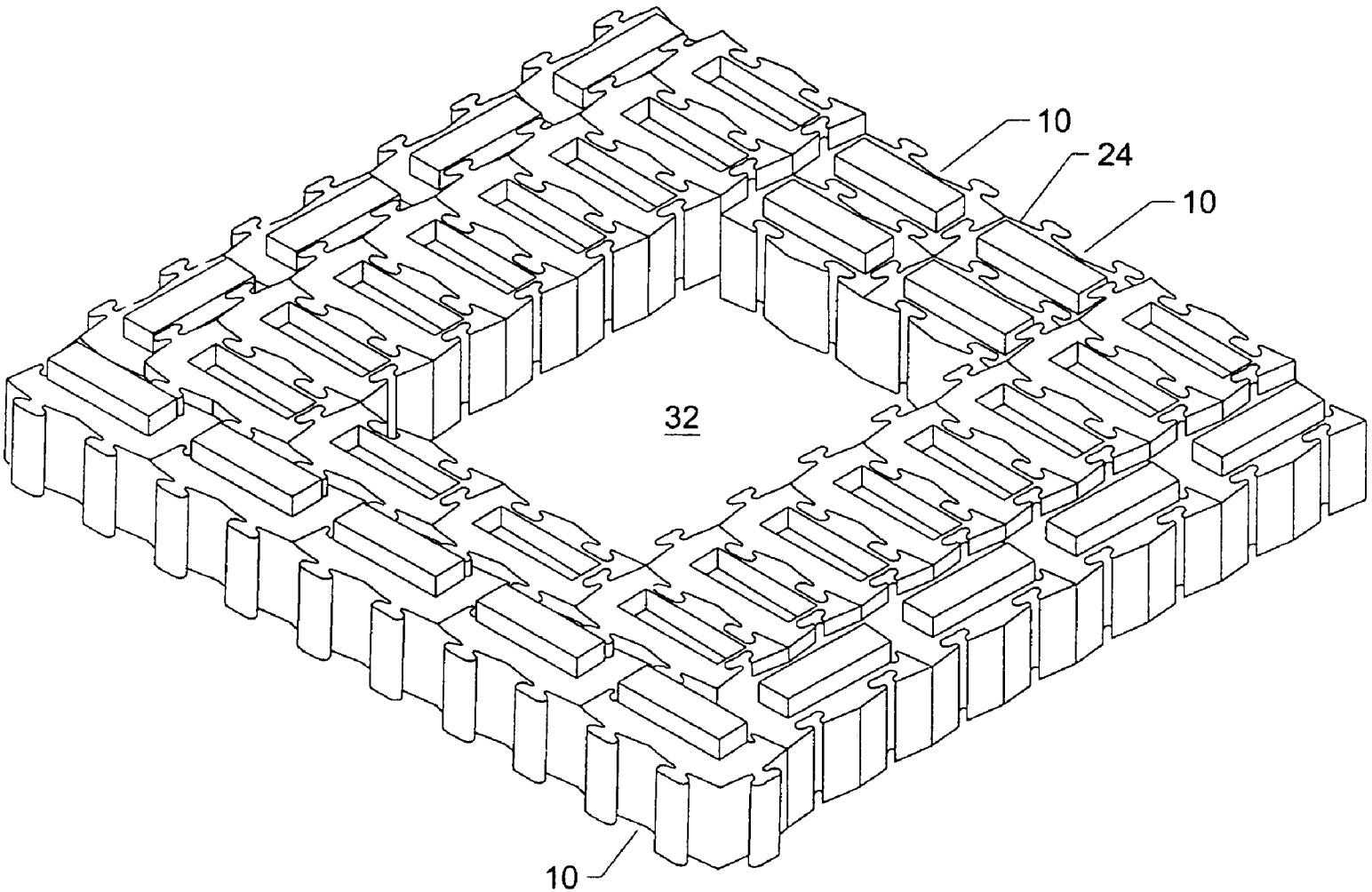
FIG. 6 illustrates the assembly of a plurality of armored building blocks to enclose a space and provide significant armor penetration protection.

FIGS. 5 and 6 illustrate a use of the blocks 10 in a manner to form both a wall and an enclosure. In FIG. 5, a wall 30 is constructed from a plurality of blocks 10, which it can be seen are interlocked using the interlocking male portions 18 and the slot portions 20. In addition, at least one additional block 10 is shown as being stacked with the rectangular projection 24 engaging the slot 28 in the lower surface 26. That interconnection cannot be seen since the blocks 10 are stacked on each other. However, in the wall 30, shown as being partially constructed, the blocks 10 have not had other blocks stacked on them and therefore illustrate the rectangular projection 24. It is understood that the lower surface 26 will include the slot 28.

Figure 7:
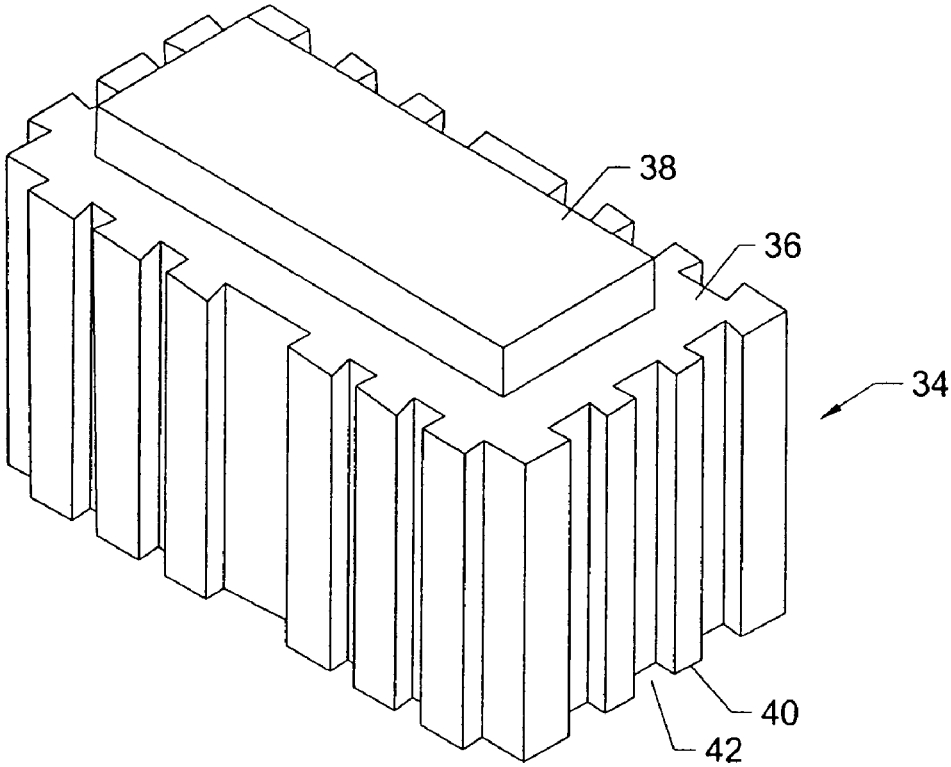
FIG. 7 is an alternative embodiment of the shape of the block of the present invention.
Figure 8:
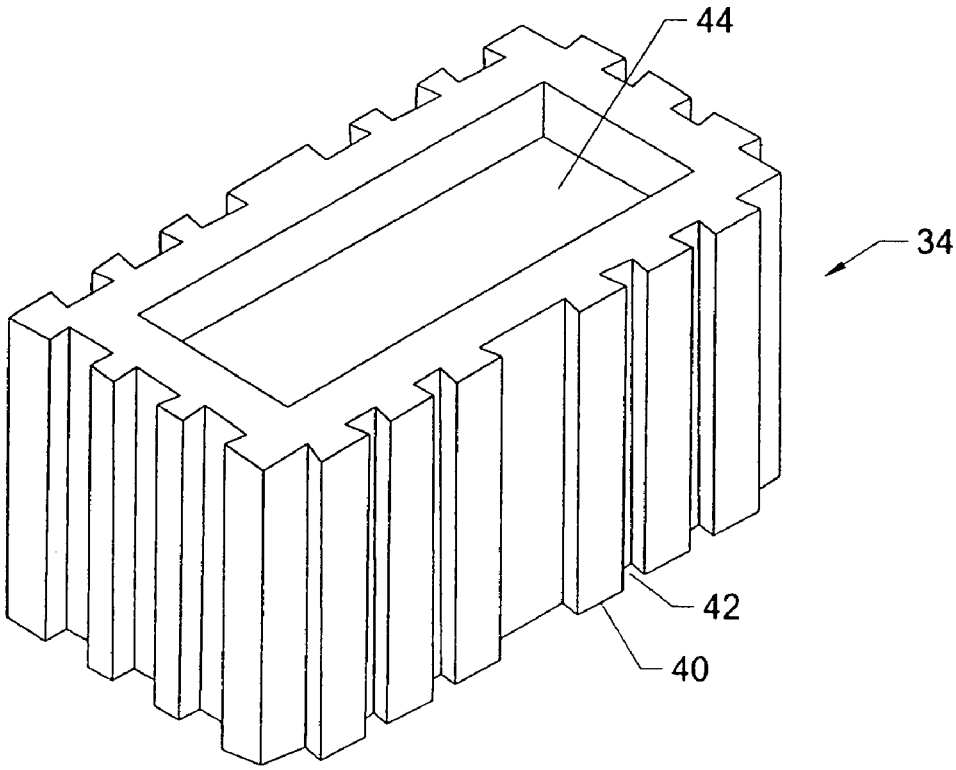
FIG. 8 is a bottom view of the block of FIG. 7.

FIG. 6 illustrates a somewhat more complex structure with a number of blocks 10 having been interconnected to form an enclosed compound 32. Note that in FIG. 6, the blocks 10 have been arranged so that the thickness of more than one block presents itself in all directions. This is done in order to provide additional protection from projectiles that might be aimed at the structure and the enclosed compound 32. As was the case with FIG. 7, FIG. 8 shows only a single layer of blocks 10. However, it will be appreciated that the arrangement of FIG. 6, to provide an enclosed compound 32, could use blocks 10 stacked as high as necessary. Once again, this stacking feature would use the rectangular projections 24 and the corresponding slot portion 28.

When using the blocks 10 of the present invention to build projectile resilient, armored structures, care should be taken to avoid butt joints with long linear seams oriented in the direction of anticipated incoming projectiles. An incoming projectile that is aligned with a butt joint seam in a wall between two blocks 10 will penetrate deeper than a projectile impacting the wall on a non-aligned section. The shape of the blocks 10 allows the flexibility to construct structures that can avoid long, straight surface segments that may form part of a butt seam, thus minimizing the possibility that a projectile will penetrate the armor structure by traveling along a butt seam between two blocks 10.

FIGS. 7 and 8 show alternative shapes for polymeric armor blocks. In FIG. 7, the armor block is designated as 34. FIG. 8 shows a bottom view of the block 34 in FIG. 7. The block 34 in FIGS. 7 and 8 can be constructed in accordance with the general internal structure described with respect to FIGS. 1 and 2. However, the external configuration for the block 34 is somewhat different than that shown with respect to FIGS. 3 and 4. The concept is identical to that previously described, in that the desire is to provide a polymeric armor block 34 that may be assembled into a variety of configurations using a single block unit for ease of inventory. In the case of the block 34, the upper surface 36 contains a rectangular projection 38. The side walls of the block 34 are formed in what might be thought of as a corrugated pattern with alternating lands 40 and valleys 42. The lands 40 and valleys 42 are cut in a manner as to allow their interconnection.

FIG. 8 shows a bottom view of the block 34 and illustrates the slot 44 that cooperates with the projection 38 to allow interlocking of the blocks 34. Thus, the block 34 shown in FIGS. 7 and 8 can be used to build structures such as that previously described with respect to FIGS. 5 and 6.

Figure 9:
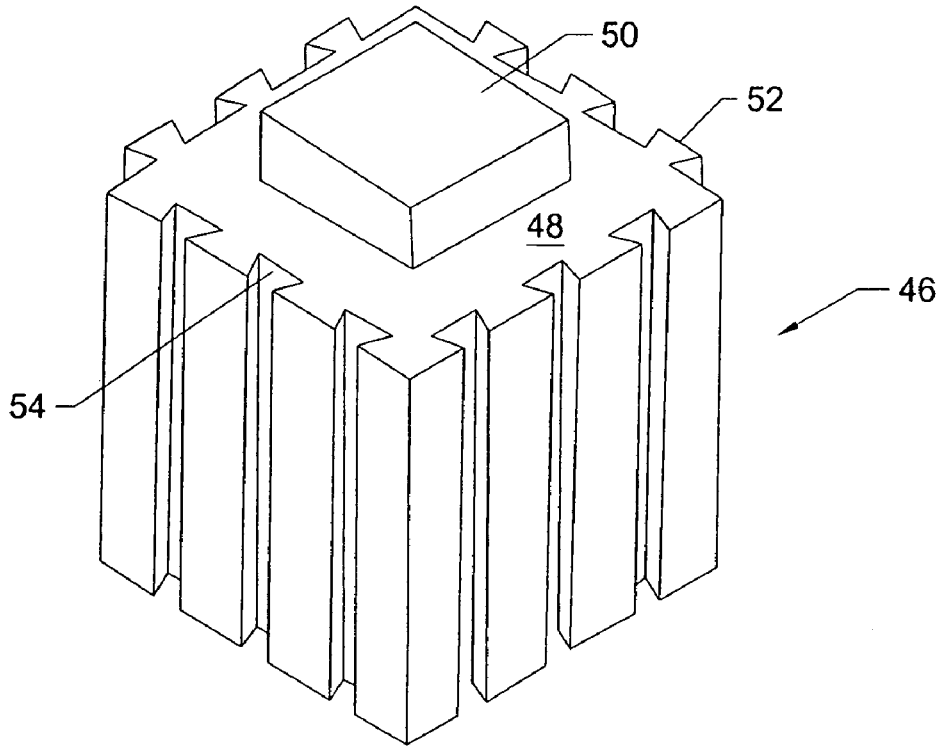
FIG. 9 is an additional embodiment of the shape of the block of the present invention.
Figure 10:
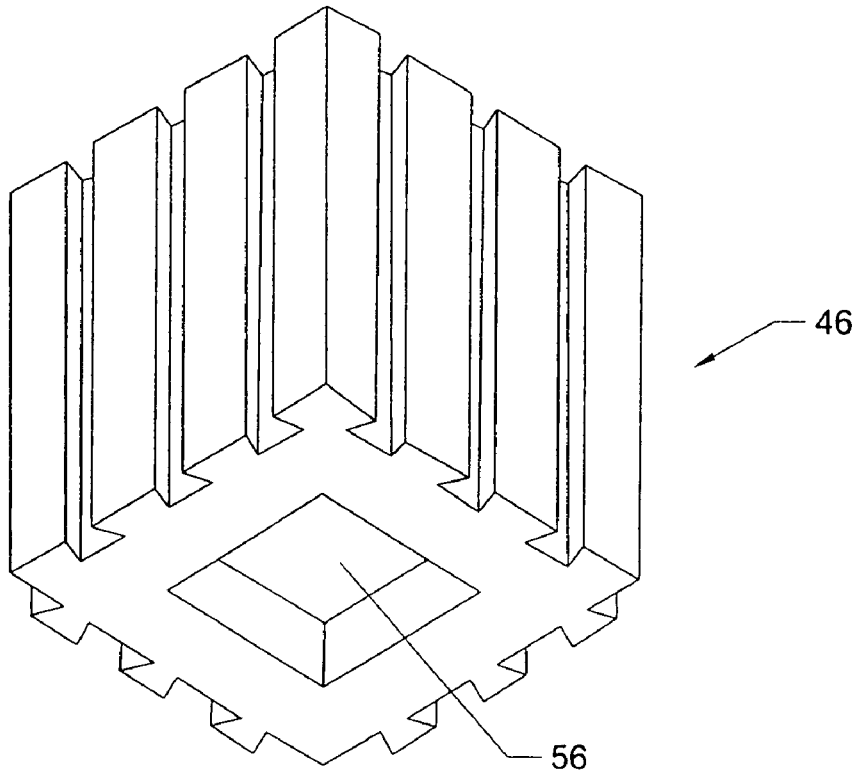
FIG. 10 shows the block of FIG. 9 from below.

FIGS. 9 and 10 illustrate yet another possible embodiment of a polymeric armor block 46. The block 46 is of a generally square configuration and has a top surface 48 that has a generally square projection 50 extending upwardly from it. The polymeric block 46 has a corrugated exterior surface, somewhat similar to that described with respect to FIGS. 7 and 8, but it can be seen that the surface of the block 46 includes dovetail projections 52 and corresponding dovetail slots 54. The dovetail projections 52 fit into the dovetail slots 54 to allow interlocking of the blocks 46. The bottom view of the block 46 in FIG. 10 shows a generally square recess portion 56 in the bottom of block 46. The square recess portion 56 will cooperate with the square projection 50 to allow vertical stacking and interlocking of the blocks 46. Again, the blocks 46 can be used in a manner similar to the blocks in FIGS. 3 and 4, and FIGS. 7 and 8 to build structures like those described with respect to FIGS. 5 and 6.

Figure 11:
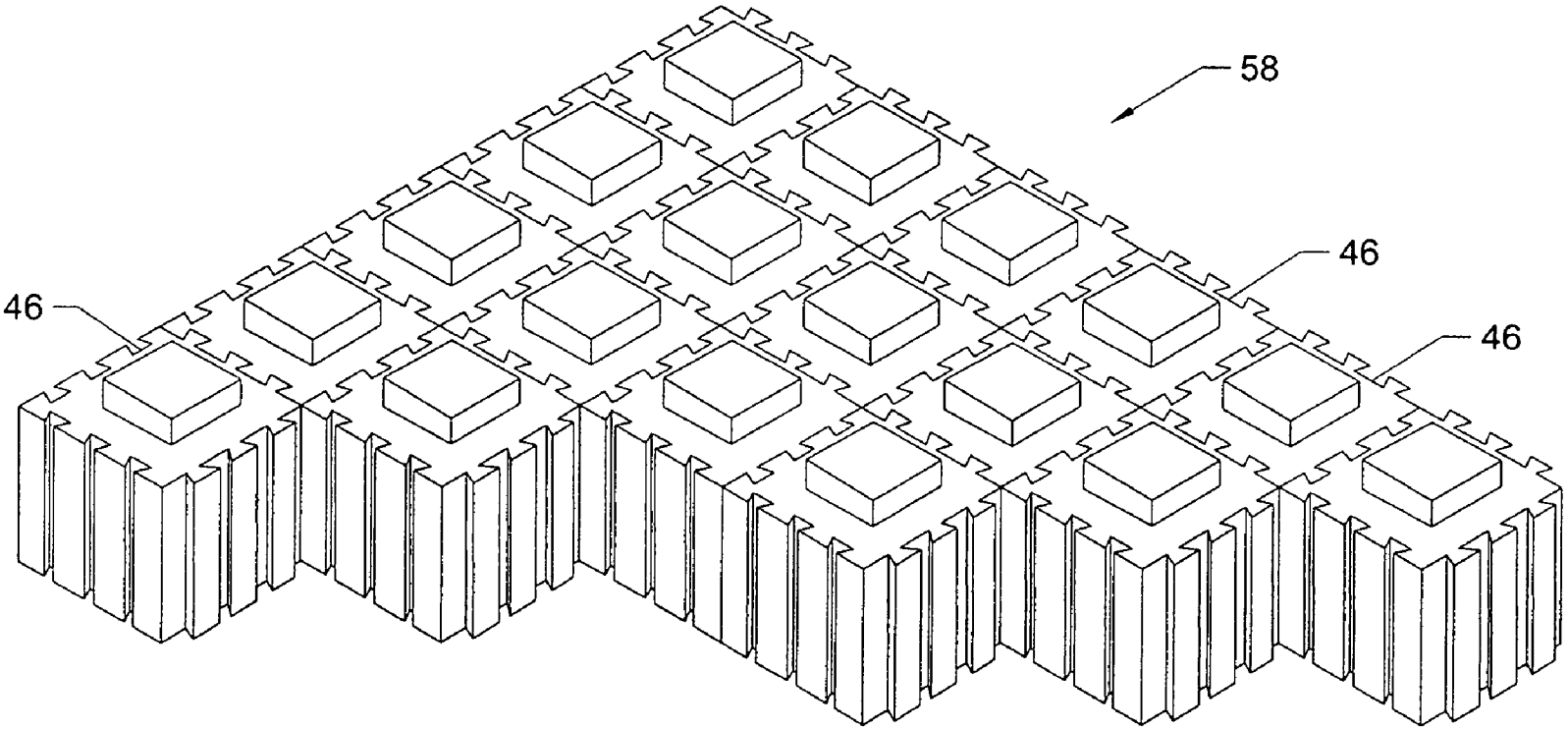
FIG. 11 shows a structure assembled from the blocks shown in FIGS. 9 and 10.

FIG. 11 shows a wall structure 58 made up of a plurality of the polymeric armor blocks, shown in FIG. 9. This illustrates the flexibility of interconnection of the blocks 46 to make structures of various configurations.

It should be understood that the lands 40, valleys 42, projection 38, slot 44, dovetail projection 52, dovetail slot 54, projection 50, and recess 46 may all be tapered in the manner described with respect to FIGS. 3 and 4. That is the interlocking portions of the blocks 34 and 46 may be angled to avoid linear seams, for reasons previously explained.

Figure 12:
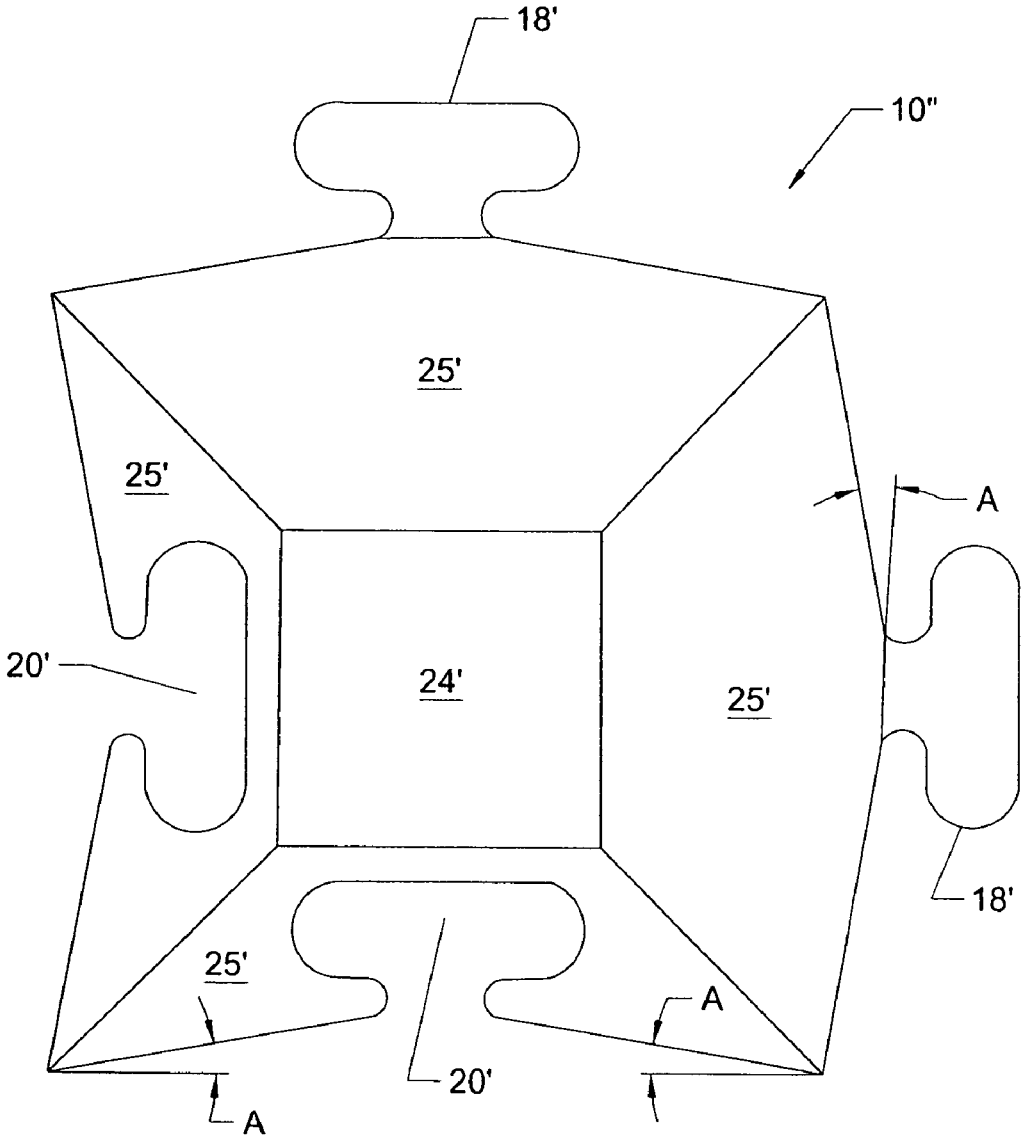
FIG. 12 is a top view of the block of the present invention.

FIG. 12 further illustrates the tapering of the sidewalls of the block of the present invention as discussed with respect to FIGS. 3 and 4. In FIG. 12, a block 10" has single male portions 18', and single slots 20', and is generally square, as opposed to the rectangular shape shown in FIGS. 3 and 4. The block 10" includes a top projection 24' and also has a corresponding bottom slot (not shown). The end walls 21' are tapered in toward the slots 20' at an angle A. The end walls 22' taper away from the male portions 18' at the same angle A. The side walls 25' of the top projection 24' also taper at the angle A.

It will be understood by those skilled in the art that while the invention has been discussed above with respect to preferred embodiments, various changes, modifications and additions can be made thereto without departing from the spirit and scope of the invention as set forth in the following claims.

What is claimed:

1. Building blocks, each comprising:

a top surface;

a bottom surface;

first and second side surfaces;

first and second end surfaces;

wherein one of the first and second side surfaces is tapered outward from the first and second end surfaces only and the other of the first and second side surfaces is tapered inward from the first and second end surfaces only;

wherein one of the first and second end surfaces is tapered outward from the first and second side surfaces only and the other of the first and second end surfaces is tapered inward from the first and second side surfaces only;

wherein one of the top and bottom surfaces is tapered outward from the first and second end surfaces and the first and second side surfaces and the other one of the top and bottom surfaces is tapered inward from the first and second end surfaces and the first and second side surfaces;

wherein the inwardly tapered surfaces are complimentary to the outwardly tapered surfaces of laterally and vertically adjacent like building blocks;

a vertical projection extending from the top surface;

a recess in the bottom surface, wherein the recess is complimentary to and positioned to receive the vertical projection of a vertically adjacent like building block when the blocks are moved vertically into top-to-bottom relationship with each other;

a vertically elongated first male locking member projecting from one of the side surfaces and having a generally T-shaped cross-section;

a vertically elongated first female locking slot formed along the other one of the side surfaces and being sized and configured to receive and lock with the male locking member on a side surface of a like building block when the blocks are moved vertically into side-by-side relationship with each other;

a vertically elongated second male locking member projecting from one of the end surfaces and having a generally T-shaped cross-section; and a vertically elongated second locking slot formed along the other one of the end surfaces and being sized and configured to receive and lock with the male locking member on an end surface of a like building block when the blocks are moved vertically into end-to-end relationship with each other;

the building blocks, when interlocked side-by-side and top-to-bottom, forming a wall having no vertical joint extending through the wall from one side of the wall to the opposite side of the wall.

2. The building blocks of claim 1, wherein the male locking members project from the side surfaces and end surfaces that are tapered outward and the female locking slots are formed in the side surfaces and end surfaces that are tapered inward.

3. The building blocks of claim 1, wherein the degree of taper of the top, bottom, side, and end surfaces is between about 15° and 16°.

4. The building blocks of claim 1, wherein the blocks are manufactured from a ballistic projectile resistant polymer containing two layers of foamed high-molecular-weight, high-density polystyrene, an outward-facing layer having a lower density than the other layer.

5. The building blocks of claim 1, wherein each building block is a non-hollow building block.

* * * * *